US005479708A

United States Patent [19]

Thomas

[11] Patent Number: 5,479,708

[45] **Date of Patent: *Jan. 2, 1996**

[54] UTENSIL HOLDER FOR INFANTS

[76] Inventor: Martha M. Thomas, 8316 E. Jamison Cir., Englewood, Colo. 80112

[ * ] Notice: The term of this patent shall not extend beyond the expiration date of Pat. No. 5,138,737.

[21] Appl. No.: 217,237

[22] Filed: Mar. 24, 1994

Related U.S. Application Data

[63] Continuation-in-part of Ser. No. 421,984, Oct. 16, 1989, abandoned, and a continuation of Ser. No. 690,547, Apr. 23, 1991, Pat. No. 5,138,737, and a continuation-in-part of Ser. No. 931,838, Aug. 18, 1992, Pat. No. 5,251,843.

[51] Int. Cl.[6] ..... A47J 43/28

[52] U.S. Cl. ..... 30/122; 30/150; 30/322; 30/324

[58] Field of Search ..... 30/147–159, 322–328, 30/340, 342, 122; 16/114 R, 114 A, 119, 125, 126

[56] References Cited

U.S. PATENT DOCUMENTS 2,494,139 1/1950 Bernstein ..... 16/114 A 5,138,737 8/1992 Thomas ..... 15/143.1

FOREIGN PATENT DOCUMENTS 111318 12/1925 Switzerland ..... 30/322

*Primary Examiner*—Douglas D. Watts
*Attorney, Agent, or Firm*—John E. Reilly

[57] ABSTRACT

A utensil holder for infants and toddlers is made up of a generally triangular handle having a hollow gripping area and a utensil-supporting portion at one side of the handle which converges forwardly and terminates in a socket end portion for insertion of a complementary shank end portion of a utensil. In another preferred form, an eating utensil is disposed with its eating surface facing in a direction substantially parallel to the longer dimension of the handle so that when the handle is grasped and held in a palmar, upright position by the infant, the eating surface can face upwardly for placement of food thereon and insertion into the infant's mouth. In the alternative, the utensil can form a permanent part of the supporting portion at one side of the handle but in either form the handle is longer in a direction transverse to the direction of entry of the utensil into the infant's mouth than the longest dimension across the infant's mouth to prevent lodging of the handle therein.

16 Claims, 3 Drawing Sheets

UTENSIL HOLDER FOR INFANTS

CROSS REFERENCE TO RELATED APPLICATIONS

This application is a continuation-in-part of Ser. No. 421,984, filed 16 Oct., 1989 for TOOTHBRUSH by Martha M. Thomas, now abandoned, and a continuation of Ser. No. 690,547, filed 23 Apr., 1991, for TOOTHBRUSH, by Martha M. Thomas, now Pat. No. 5,138,737, issued 18 Aug., 1992 and a continuation-in-part of Ser. No. 931,838, filed 18 Aug., 1992, for UTENSIL HOLDER FOR INFANTS, invented by Martha M. Thomas now U.S. Pat. No. 5,251,843.

SPECIFICATION

This invention relates to utensil holding devices; and more particularly relates to a novel and improved utensil holder for use by persons with limited or developing motor skills, such as, infants and toddlers and which is characterized in particular by a handle which is designed for interchangeable use with different utensils or implements.

BACKGROUND AND FIELD OF INVENTION

I have previously devised a toothbrush for infants which incorporates a handle design that is easy to grip and manipulate, all as set forth and described in my hereinbefore referred to Pat. No. 5,138,737, and which is incorporated by reference herein. Now it is proposed to incorporate a handle of that type as a holder for various utensils and particularly eating utensils for younger children which can be easily grasped and manipulated while minimizing the danger of injury to the mouth or becoming lodged in the mouth or throat.

Infant utensil holders and particularly for feeding utensils have been devised in the past. For example, U.S. Pat. No. 1,625,003 to M. W. Walker discloses a generally loop-shaped handle which serves as a part of a baby boom. Pat. No. 4,207,673 to M. DiGirolamo et al discloses a utensil handle which can be electrically controlled to receive different utensils. U.S. Pat. No. 3,839,793 to A. C. Crapio is directed to a handle which will facilitate releasable attachment of different utensils; and Design Patent No. 318,401 to M. W. Beaumont discloses a generally loop-shaped handle as a part of a utensil holder. U.S. Pat. No. 4,654,921 to M. E. W. Dinner also disclose an infant toothbrush which includes a handle in the form of an oval ring to facilitate gripping by an infant. Other representative patents in this field are U.S. Pat. Nos. 1,065,170 to H. Poettich, 1,618,189 to A. J. Hansen, 2,762,120 to F. J. Mack, 3,865,115 to P. DeMieri, 4,821,417 to A. H. Levine, Design 132,441 to M. E. Graves, Design 161,359 to H. C. Milne, Design 167,623 to N. C. Eue, Design 168,021 to J. DeHymel and Design 191,406 to N. A. Newmark.

Nevertheless, the patents referred to above fail to address the problem of providing a handle for a utensil holder which can be easily grasped and manipulated by an infant or anyone with limited motor skills but at the same time will greatly minimize the danger of injury to the mouth or of becoming lodged in the mouth or throat. When the utensil holder is used with eating utensils, it is desirable that the handle be so oriented with respect to the utensil as to encourage grasping by the infant with the eating surface of the utensil facing in an upward direction for ease of picking up food and directing it into the mouth; and the grasp required to hold the handle assists the smaller muscle groups of the infant or child so that the child can obtain more control over the utensil with less effort. The grip of the fingers also acts as a brace to the wrist, forcing it to remain stationary, thereby substantially decreasing the infant's ability to accidentally spill or deliberately fling food from the utensil. Further, there is a need for a utensil holder in which the handle will permit interchangeable use with different utensils or implements, such as, a toothbrush, feeding utensils, pencils and crayons and whether formed as a permanent part of the holder or interchangeably inserted into the handle portion and in such a way as not to be removable by the infant.

SUMMARY OF INVENTION

It is therefore an object of the present invention to provide for a novel and improved utensil holder that can be easily manipulated by infants and other persons with limited motor skills.

It is another object of the present invention to provide for a novel and improved utensil holder incorporating a handle which can be interchangeably used with different utensils including but not limited to feeding utensils, toothbrushes, and writing implements.

It is a further object of the present invention to provide for a novel and improved infant utensil holder which is versatile and can be easily and economically manufactured; and further wherein the utensil holder incorporates a handle which may be stored in an upright position and is aesthetically appealing to adults and children alike increasing the likelihood of acceptance and use.

It is an additional object of the present invention to provide a utensil holder for certain utensils in which a handle portion is so oriented with respect to the utensil as to enable grasping of the handle by the infant such that the utensil will face in an upward direction, specifically wherein the utensil is an eating utensil with its eating surface facing in an upright direction to facilitate picking up food and directing it into the mouth; and wherein the handle includes a crook which connects the handle to the utensil and can act as a prop when the handle is resting against or placed in a bowl, and the handle itself is so designed as to alleviate pressure on small muscle groups while at the same time effecting a more secure grip.

In accordance with the present invention, a utensil holder has been devised for use by infants and toddlers which comprises a utensil holder for use by infants and toddlers comprising an elongated, generally loop-shaped handle including a hollow gripping area for insertion of the fingers of the infant's hand, a utensil-supporting portion disposed at one side of the handle intermediately between opposite ends of the handle, and the handle converging forwardly from the opposite ends into the utensil-supporting portion and a utensil attached to the utensil-supporting portion, the handle being longer in a direction transverse to the direction of entry of the utensil-supporting portion into the infant's mouth than in a direction parallel to the direction of entry and longer in the transverse direction than the longest dimension across the infant's mouth to prevent lodging of the handle in the infant's mouth. For certain utensils, such as, eating utensils, the eating surface is oriented to face in a direction parallel to the longer dimension of the handle so that when the handle is grasped and held by the infant in an upright position, the eating surface can face upwardly for ease of picking up food and directing it into the infant's mouth.

In a preferred form of the invention, the generally loop-shaped handle is of generally triangular configuration and includes a flat base portion along one side with inclined side portions converging into an intermediate utensil-supporting portion or crook which includes a socket at one end to receive a complementary insert portion at one end of the utensil; and when used as a holder for feeding utensils, such as, a fork or spoon the longer dimension of the handle is aligned normal to the direction of the utensil into the mouth.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
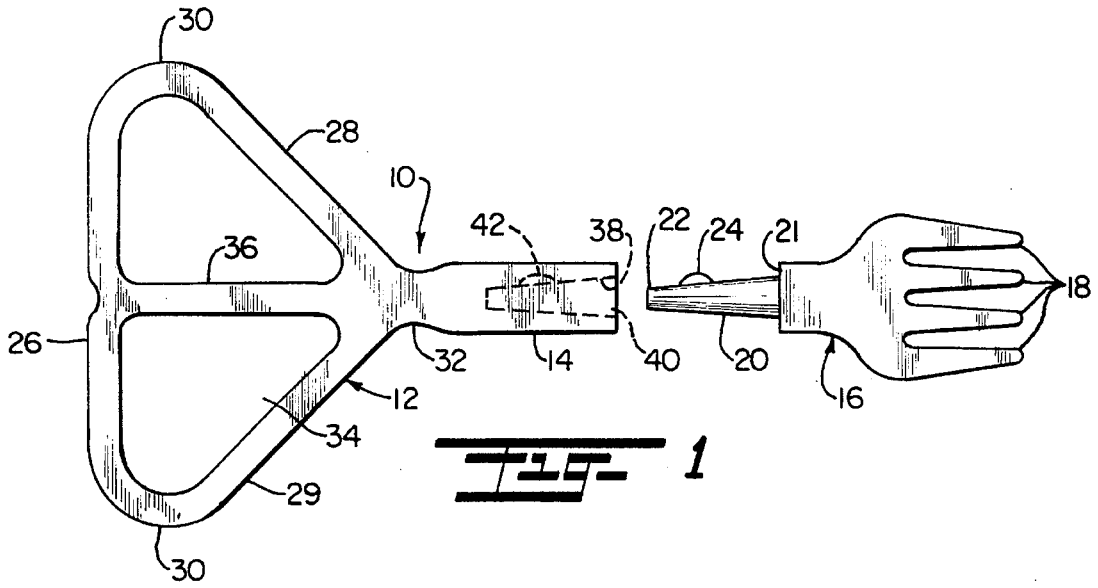
FIG. 1 is a front view in elevation of a preferred form of invention illustrating the handle and utensil in exploded form.
Figure 2:
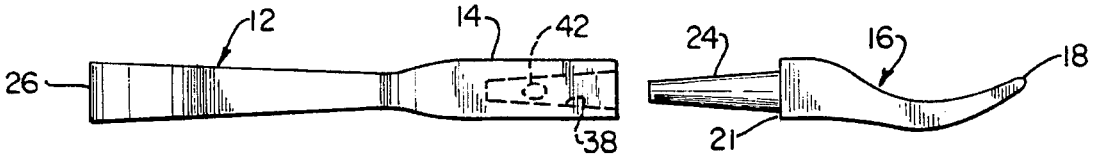
FIG. 2 is a side view of the preferred form shown in FIG. 1.
Figure 3:
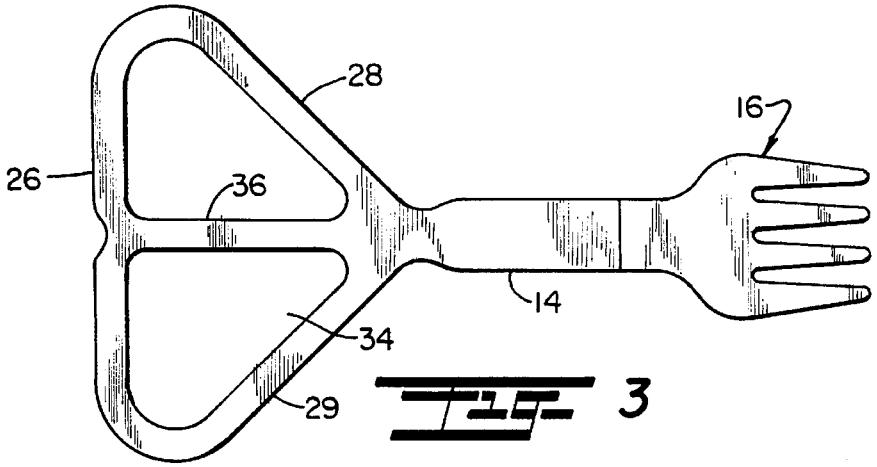
FIG. 3 is another front view of the preferred form illustrating the parts in assembled relation.

Referring in more detail to the drawings, there is illustrated in FIGS. 1 to 3 a preferred form of utensil holder 10 which is made up of a generally loop-shaped handle 12 having a utensil-supporting portion 14 for a separate utensil 16. The utensil 16 is illustrated as a feeding utensil and which is representative of various types of utensils or implements which can be releasably connected to the handle portion. As shown, the feeding utensil 16 is in the form of a fork having a plurality of tines 18 and a tapered shank 20 which converges or tapers away from a shoulder 21 opposite to the tined end of the fork and terminates in a free end 22. A slight protuberance 24 is formed on the surface of the shank to facilitate a secure but releasable connection to the handle in a manner to be described.

The handle 12 is of generally triangular configuration including a flat base 26 and inclined side portions 28 and 29 which converge from opposite rounded ends 30 of the base into a common apex 32 opposite to the base 26. The base 26 and inclined side portions 28 and 29 define a hollow or open triangular gripping area 34 which is bisected by a common center bar 36 extending from the base 26 into the apex 32. As best seen from FIG. 2, the side portions 28 and 29 as well as the bar 36 taper in thickness away from the base plate 26, and the flat base permits storage or placement of the holder 10 in an upright position on a table or other flat surface when not in use.

The utensil-supporting portion 14 is preferably in the form of an elongated generally cylindrical stem which extends away from the apex 32 and includes a socket 38 with an open end or entrance 40 at the free end of the portion 14. The socket tapers inwardly away from the entrance 40 and symmetrically about a longitudinal axis of the supporting portion 14 and is dimensioned to be complementary to the tapered shank 20 for snugfitting insertion of the shank 20 into the socket until the shoulder 21 abuts the end of the socket, as shown in FIG. 3. A slight depression 42 is formed in the inner wall of the socket 38 to receive the protuberance 24 on the shank 20 and establish a positive but releasable connection between the utensil 16 and supporting portion 14 and thereby assume the assembled relationship as illustrated in FIG. 3.

Figure 4:
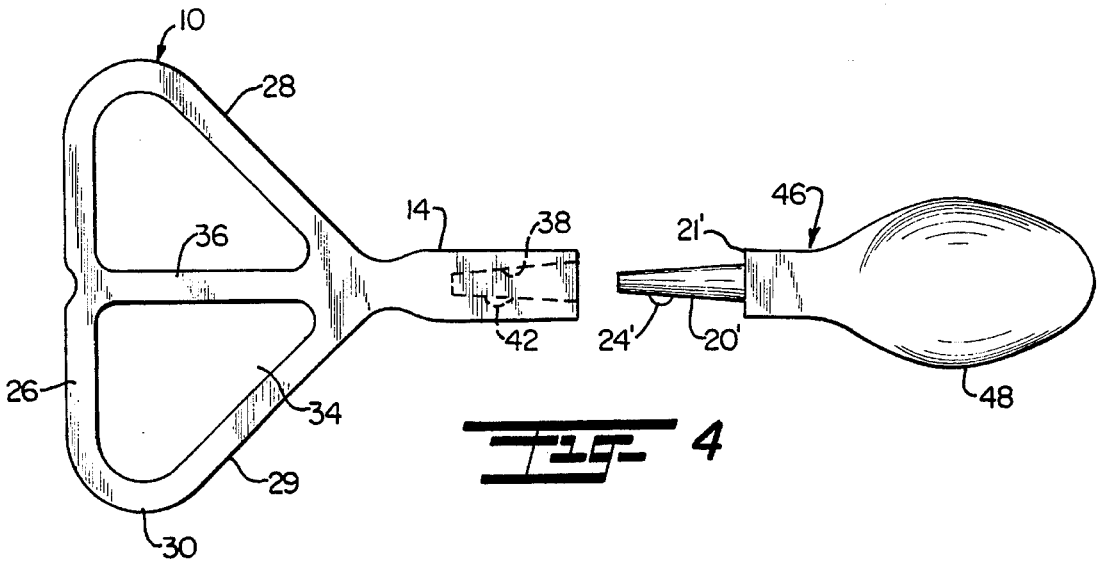
FIG. 4 is a front view in elevation of another preferred form illustrating the handle and utensil in exploded form.
Figure 5:
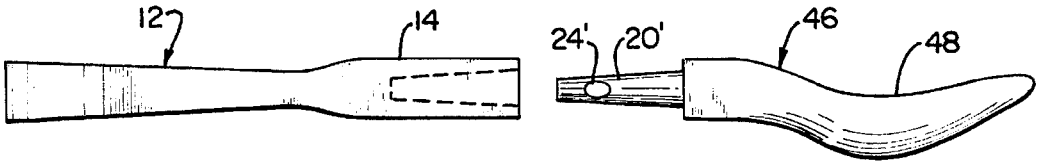
FIG. 5 is a side view of the preferred form shown in FIG. 4.
Figure 6:
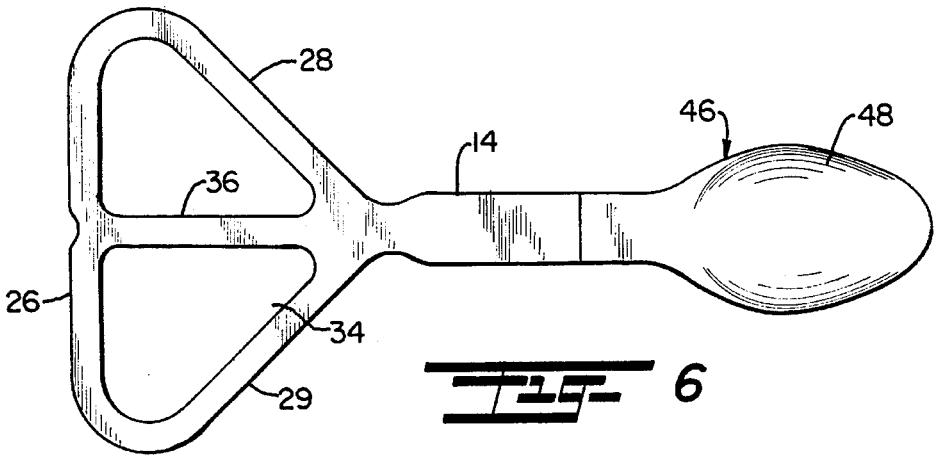
FIG. 6 is a front view in elevation of the preferred form shown in FIGS. 4 and 5 in assembled relation.

The preferred form of utensil holder 10 as described is so constructed and arranged as to be conformable for use with various utensils or implements. For example, FIGS. 4 to 6 illustrate another feeding utensil 46 in the form of a spoon having a generally bowl-shaped end portion 48 and a tapered shank 20' corresponding to the tapered shank 20 of the form of FIGS. 1 to 3 for insertion into the socket end portion 38 of the handle 12. In this relation, the handle 12 corresponds to that shown in FIGS. 1 to 3 and like parts are correspondingly enumerated.

An important feature of the present invention is that the handle 12 is designed such that the base 26 is dimensioned to be longer in a direction transverse to the direction of entry of the utensil into the infant's mouth so that the infant cannot accidentally force the holder into the mouth, and the sides 28, 29 have generally sloping surfaces which converge forwardly and away from the base so that in the event that the infant should fall or otherwise attempt to force the holder into the mouth will minimize the danger of damage to the mouth. Further, in training an infant to use the utensil holder 10, the infant can conveniently pass the fingers of one hand around the base 26 of the gripping area and on either side of the center bar 36. The center bar 36 will offer additional stability and assist the infant in manipulating or turning the handle in picking up food and passing into the mouth. As an alternative, the center bar 36 can be eliminated, although it does afford an additional means of grasping and manipulating the handle of the utensil holder in use.

The socket end portion 38 and cooperating shank 20 are so constructed as to assure a secure but releasable connection between the utensil and handle and particularly in the utilization of a protuberance 24 or 24' in cooperation with the depression 42. Specifically, when the shank 20 or 20' is inserted into the socket end portion 38, the protuberance 24 or 24' must be forced along the inner wall of the socket until it moves into alignment with the depression 42 and will snap securely in place. In this way, an adult will have sufficient strength to connect and release the utensil but the infant will not be able to do so. In addition, the utensil will be locked against rotation or shifting with respect to the handle and the longer dimension of the handle will extend transversely to the direction of entry of the utensil into the infant's mouth.

Both the utensil 16 or 46 and handle 12 or 12' may be suitably composed of a synthetic resin or plastic material of the type employed in conventional toothbrush handles or, in the alternative, can be composed of softer, more resilient materials of the type commonly used in toys. Generally, the composition of the material should be such there is sufficient strength, particularly at the interconnecting shank and socket end portions, to resist accidental removal or release of the utensil once attached to the handle.

Figure 7:
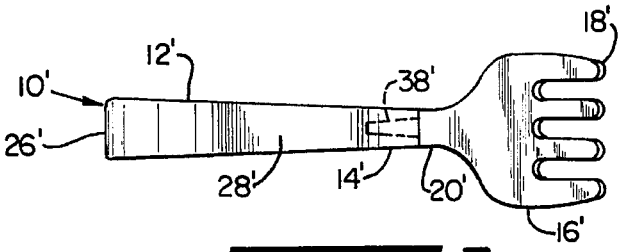
FIG. 7 is a front view in elevation of another preferred form of eating utensil.
Figure 8:
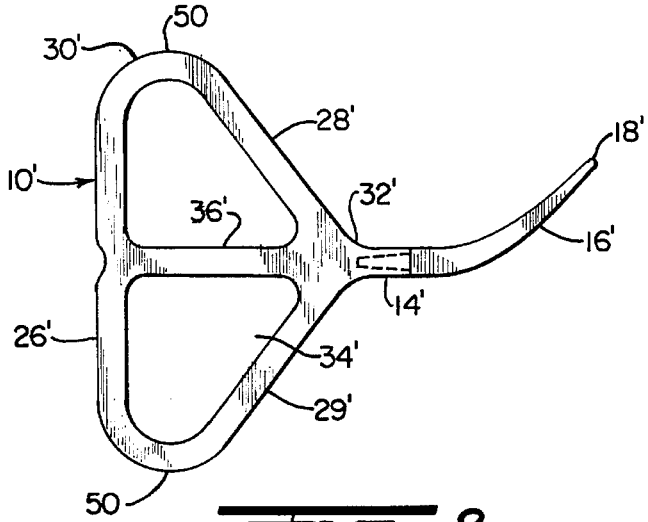
FIG. 8 is a side view of the form shown in FIG. 7.

In another preferred form of invention shown in FIGS. 7 to 10, like parts to those of the utensil holders shown in FIGS. 1 to 6 are correspondingly enumerated with prime numerals. Referring to FIGS. 7 and 8, the utensil holder 10' has a generally loop-shaped handle 12' with a utensil-supporting portion 14' for a separate eating utensil in the form of a fork 16' having a plurality of tines 18' of generally concavo-convex configuration and a tapered shank 20' which is releasably attached to the utensil-supporting 14' in a manner corresponding to that illustrated in FIGS. 1 and 2 but with the fork 16' and its tines 18' aligned at right angles to that illustrated in FIGS. 1 and 2. The handle 12' is generally triangular with a flat base portion 26' and side portions 28' and 29' sloping from opposite ends 30' of the base and intersecting at a common apex 32' opposite to the base. The gripping area 34' formed within the triangular handle is bisected by a common bar 36'. The side portions 28' and 29' and the bar 36' taper away from the base 26' and merge with the utensil-supporting 14' which is correspondingly tapered and which terminates in a socket 38' at the open or free end of the portion 14'. The socket permits snugfitting insertion of the shank end of the utensil 16' in a manner corresponding to that described in relation to FIGS. 1 to 6 and therefore is not shown in detail; however, the tines 18' are disposed at right angles to those of FIGS. 1 to 3; or, in other words, are oriented such that the concave side or eating surface of the tines can face in a direction substantially parallel to the longer dimension of the handle 12' which is that dimension extending between opposite end portions 30' across the base 26'. It has been found that the infant or toddler will most naturally and easily grasp the handle such that the fingers curl around the base portion into the gripping area 34'; and with the eating surface oriented as described, the infant or toddler can more easily place food on the untensil and direct it into his or her mouth. The flat external edge or surface 50 at each opposite end 30' will enable the holder to rest in an upright position on one edge 50 and on the back or convex surface of the fork opposite to the eating surface when not in use. In addition, the tapered shank or crook of the handle which interconnects the handle to the utensil portion may act as a prop when the handle is left in a bowl by resting the crook on the lip of the bowl thus affording easier access to the infant or child in continuing the processing of eating with less opportunity for the utensil to sink into the bowl.

Figure 9:
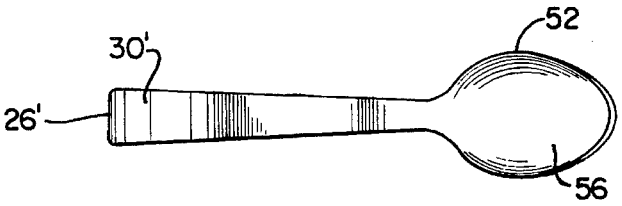
FIG. 9 is a front view of another preferred form corresponding to that of FIGS. 7 and 8 in which the eating utensil is a spoon.
Figure 10:
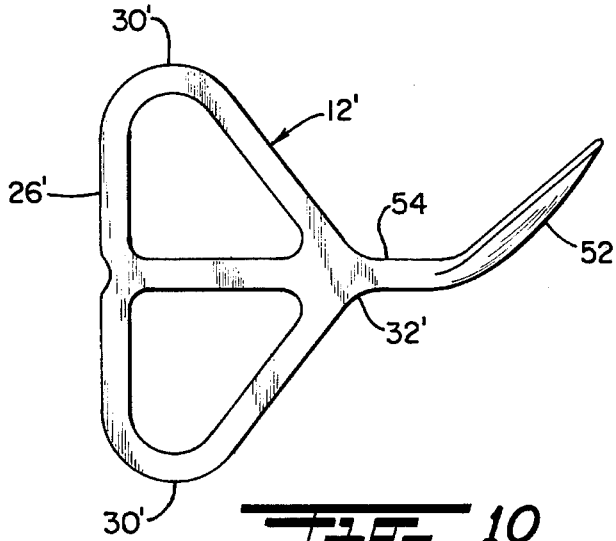
FIG. 10 is a side view of the form shown in FIG. 9.

In FIGS. 9 and 10, a one-piece utensil holder is shown in which the handle 12' corresponds to that of FIGS. 7 and 8 and like parts are correspondingly enumerated. However, an eating utensil in the form of a spoon 52 is integrally formed with a shank 54 which defines a utensil-supporting portion extending from the apex 32' of the triangular handle 12. The spoon 52 is of generally concavo-convex configuration in which concave surface 56 defines the eating surface of the handle and is aligned so that the eating surface generally faces in a direction parallel to the longer dimension of the handle; i.e., in the longitudinal direction of extension of the base portion 26'. In a manner corresponding to that described in connection with FIGS. 7 and 8, the child in grasping the base portion such that the fingers are curled around the base into the gripping area and holding in the upright position against the palm of the hand can more easily pick up food on the surface 56 and direct it into his or her mouth.

Although the present forms of invention shown have been described specifically in relation to a utensil holder for feeding utensils, such as, the fork 16 or 16' and spoon 46 or 52, it will be evident that the handle 12 or 12' is readily conformable for use in cooperation with various other utensils or implements having a shank end portion adapted to fit into the socket end 38 as described. By way of illustration and not limitation, toothbrushes, pencils, crayons, eating knives can be made with the appropriate shank end portions to securely but releasable fit into the socket end portion 38 or 38' of the handle 12 or 12'. The handle is so constructed and arranged that it is adaptable for use with numerous other products including a paintbrush for water colors, pacifier, cup with handles on either side, hairbrush and comb set, popsicle stick or lollipop holder. As another suitable alternative, the utensil holder of the present invention can be formed as a one-piece unit with the utensil permanently attached to the utensil-supporting side or portion of the handle, as shown in FIGS. 9 and 10.

It is therefore to be understood that while preferred forms of invention have been herein set forth and described the above and other modifications and changes may be made in the construction, arrangement and composition of parts without departing from the spirit and scope of the present invention as defined by the appended claims and reasonable equivalents thereof.

I claim:

1. A utensil holder for use by infants and toddlers comprising:

an elongated, generally triangular handle having a plurality of sides, said handle including a hollow gripping area for insertion of the fingers of the infant's hand, a utensil-supporting portion disposed at one side of said handle intermediately between opposite ends of said handle, and said handle having converging portions extending from said opposite ends into said utensil-supporting portion, wherein said gripping area is of generally triangular shape, said handle having a bar member substantially bisecting said gripping area defining intermediate gripping means to alleviate pressure on small muscle groups of the hand while effecting a secure grip with said handle; and a utensil attached to said utensil-supporting portion, said handle being longer in a direction transverse to a direction of entry of said utensil-supporting portion into the infant's mouth than in a direction parallel to said direction of entry and being longer in said transverse direction than the longest dimension across the infant's mouth to prevent lodging of said handle in the infant's mouth.

2. A utensil holder according to claim 1, said handle having sloping surfaces converging forwardly from said opposite ends into said utensil-supporting portion, and said utensil including a shank extending from said utensil-supporting portion in a direction parallel to an imaginary plane passing through said handle.

3. A utensil holder according to claim 1, said utensil-supporting portion including means for releasable securing said utensil to said utensil-supporting portion whereby said utensil extends forwardly in a direction normal to the length of said handle.

4. A utensil holder according to claim 1, said utensil-supporting portion extending in a direction normal to the length of said handle, and means for releasably attaching said utensil to said utensil-supporting portion whereby to prevent accidental removal of said utensil from said handle when in use.

5. A utensil holder according to claim 4, said attaching means including a socket at one end of said utensil-supporting portion, a complementary shank portion on said utensil inserted into said socket, and cooperating male and female connecting elements between said socket and said shank portion.

6. A utensil holder for use by infants and toddlers comprising:

a generally triangular handle including a hollow gripping area dimensioned for insertion of the fingers of an infant's hand, said handle including a utensil-supporting portion, a substantially flat base portion and inclined side portions converging from opposite ends of said base portion into said utensil-supporting portion, and a bar substantially bisecting said gripping area and extending in a direction substantially parallel to said utensil-supporting portion; and said utensil-supporting portion including a stem extending normal to said base portion, and a utensil having a connecting end portion connected to a free end of said stem and said handle being elongated in a direction transverse to the direction of entry of said utensil-supporting portion into an infant's mouth, said utensil having a free end portion provided with a work surface to be used by the infant, said work surface facing in a direction substantially parallel to the longer direction of said handle whereby when said handle is in an upright position in the infant's hand, said work surface can either face upwardly or downwardly according to its intended use.

7. A utensil holder according to claim 6, including a socket portion at said free end of said stem, and said connecting end portion including a shank inserted into said socket portion.

8. A utensil holder according to claim 7, said socket portion and said connecting end portion having complementary male and female connecting members to establish snap-fit engagement between said utensil and said utensil-supporting portion.

9. A utensil holder according to claim 8, said connecting members including a protuberance on a surface of said shank and a depression on an inner surface of said socket aligned to receive said protuberance on said shank.

10. A utensil holder according to claim 8, said socket and said shank portions having complementary tapered surfaces in snug-fitting engagement with one another.

11. A utensil holder for use by infants and toddlers comprising:

an elongated, generally loop-shaped handle including a hollow gripping area for insertion of the fingers of the infant's hand, a utensil-supporting portion including a socket disposed at one side of said handle intermediately between opposite ends of said handle, and said handle having its longer dimension extending between the opposite ends and said longer dimension of said handle being longer than the longest dimension across the infant's mouth to prevent lodging of said handle in the infant's mouth; and an eating utensil attached to said utensil-supporting portion including a complementary shank portion releasably inserted into said socket, said eating utensil having a generally concave eating surface facing in a direction substantially parallel to said longer dimension of said handle so that when said handle is in an infant's hands in a palmar, upright position said concave eating surface can face upwardly for placement of food thereon and insertion into the infant's mouth.

12. A utensil holder according to claim 11, said handle being of generally triangular configuration including a base portion extending along said longer dimension of said handle between the opposite ends thereof and sloping surfaces of said handle converging forwardly from the opposite ends into said utensil-supporting portion.

13. A utensil holder according to claim 12, said handle defining a generally triangular gripping area and including a bar member substantially bisecting said gripping area.

14. A utensil holder according to claim 13, said utensil-supporting portion including a stem extending normal to said base portion, and said utensil having a connecting end portion connected to a free end of said stem.

15. A utensil holder according to claim 14, said utensil-supporting portion including a socket at one end, and a complementary shank portion on said utensil releasably inserted into said socket.

16. A utensil holder for use by infants and toddlers comprising:

a generally triangular handle including a hollow gripping area dimensioned for insertion of the fingers of an infant's hand, said handle including a utensil-supporting portion, a substantially flat base portion and inclined side portions converging from opposite ends of said base portion into said utensil-supporting portion, and a bar substantially bisecting said gripping area and extending in a direction substantially parallel to said utensil-supporting portion; and said utensil-supporting portion including a stem extending normal to said base portion, a socket portion at a free end of said stem, and a utensil having a connecting end portion including a shank inserted into said socket portion and said handle being elongated in a direction transverse to the direction of entry of said utensil-supporting portion into an infant's mouth, said utensil having a free end portion provided with a work surface to be used by the infant, said work surface facing in a direction substantially parallel to the longer direction of said handle whereby when said handle is in an upright position in the infant's hand, said work surface can either face upwardly or downwardly according to its intended use.

* * * * *